US008502748B2

(12) United States Patent
Liang et al.

(10) Patent No.: US 8,502,748 B2
(45) Date of Patent: Aug. 6, 2013

(54) THREE-DIMENSIONAL DUAL-BAND ANTENNA

(75) Inventors: Mao-Tse Liang, Hsinchu (TW); Shih-Chieh Cheng, Tainan County (TW); Kuo-Chang Lo, Miaoli County (TW)

(73) Assignee: Arcadyan Technology Corporation, Hsinchu (TW)

( * ) Notice: Subject to any disclaimer, the term of this patent is extended or adjusted under 35 U.S.C. 154(b) by 349 days.

(21) Appl. No.: 12/870,298

(22) Filed: Aug. 27, 2010

(65) Prior Publication Data

US 2011/0050523 A1 Mar. 3, 2011

(30) Foreign Application Priority Data

Aug. 28, 2009 (TW) ..... 98129023 A

(51) Int. Cl.
*H01Q 1/50* (2006.01)

(52) U.S. Cl.
USPC ..... 343/860; 343/702; 343/729; 343/792

(58) Field of Classification Search
USPC ..... 343/700 MS, 702, 770, 846, 820, 343/844, 850, 860, 893, 914
See application file for complete search history.

(56) References Cited

U.S. PATENT DOCUMENTS

| | | | | |
|---|---|---|---|---|
| 7,242,352 | B2 * | 7/2007 | Tavassoli Hozouri | 343/700 MS |
| 7,403,160 | B2 * | 7/2008 | Chiang et al. | 343/702 |
| 7,705,791 | B2 * | 4/2010 | Ollikainen | 343/702 |
| 7,920,095 | B2 * | 4/2011 | Wei | 343/700 MS |
| 2005/0057400 | A1 * | 3/2005 | Yuanzhu | 343/700 MS |

FOREIGN PATENT DOCUMENTS

| | | |
|---|---|---|
| CN | 101527387 A | 9/2009 |
| TW | M286998 U | 2/2006 |

* cited by examiner

*Primary Examiner* — Shawki Ismail
*Assistant Examiner* — Christopher Lo
(74) *Attorney, Agent, or Firm* — Rabin & Berdo, P.C.

(57) ABSTRACT

A three-dimensional dual-band antenna including a first radiation portion, a second radiation portion, a connection portion, an impedance matching portion and a feeding portion is provided. The second radiation portion is located under the radiation portion and parallel with the first radiation portion. The connection portion is connected to the first side of the first radiation portion and extended downward vertically, for connecting the first radiation portion and the second radiation portion. The impedance matching portion is connected to a second side of the first radiation portion and extended downward vertically. The first side and the second side are opposite. The feeding portion is connected to the second side and extended downward vertically. The feeding portion receives a feeding signal. The first and the second radiation portion are operated at the first and the second bandwidth respectively, wherein the second bandwidth is in higher frequency than the first bandwidth.

19 Claims, 8 Drawing Sheets

THREE-DIMENSIONAL DUAL-BAND ANTENNA

This application claims the benefit of Taiwan application Serial No. 98129023, filed Aug. 28, 2009, the subject matter of which is incorporated herein by reference.

BACKGROUND OF THE INVENTION

1. Field of the Invention

The invention relates in general to a three-dimensional dual-band antenna, and more particularly to a three-dimensional dual-band antenna having broadband characteristic.

2. Description of the Related Art

Antennas are important in communication industry which has gained rapid advance in recent years. In general, antennas are used in various small-sized electronic devices such as notebook computers or portable electronic devices.

Antennas can be categorized into planar antennas and three-dimensional antennas; and both types of antennas are capable of receiving/transmitting radiation electromagnetic field. In general, the three-dimensional antenna has better performance. The three-dimensional antenna is exemplified below in receiving the radiation electromagnetic field; and the reasons for the superior performance of the three-dimensional antenna are also disclosed.

Antennas are normally disposed on a circuit board having circuit elements. The radiation electromagnetic field received by the antenna located at the receiver is transmitted by the standing antenna of the base station. In comparison to the planar antenna, the three-dimensional antenna is less affected by the shielding effect of the circuit element.

Moreover, the current flows in the three-dimensional antenna are distributed in both the horizontal direction and the vertical direction. The horizontal direction is the direction parallel with the circuit board; and the vertical direction is the direction parallel with the standing antenna of the base station. In comparison to the planar antenna whose current flow is distributed only in the horizontal direction, the three-dimensional antenna has higher radiation electromagnetic field stability between the standing antenna of the base station.

When the planar antenna receives the radiation electromagnetic field, the current flow is distributed in the horizontal direction and transmitted to the circuit elements disposed on the circuit board. Since the current flows of the circuit elements are normally in the horizontal direction, the current of the planar antenna generates electromagnetic interference which affects the circuit element. However, when the three-dimensional antenna receives the radiation electromagnetic field, the current is distributed in the horizontal direction as well as the current path in the vertical direction. Thus, the current distributed in the horizontal direction is not so high, and the electromagnetic interference effect is reduced accordingly.

However, the conventional three-dimensional antenna normally has a huge volume, and the volume of the three-dimensional dual-band antenna is even larger. Moreover, the communication bandwidth at which the conventional three-dimensional antenna is operated is restricted. Thus, how to provide a small-sized three-dimensional dual-band antenna having broadband is a prominent for the industries.

SUMMARY OF THE INVENTION

One example of the invention is directed to a three-dimensional dual-band antenna which is capable of supporting two communication bandwidths and has a small-sized volume.

The three-dimensional dual-band antenna can receive/transmit signals at wide communication bandwidth, so the two communication bandwidths supported by the three-dimensional dual-band antenna both are broadband.

According to an example of the present invention, a three-dimensional dual-band antenna is provided. The three-dimensional dual-band antenna includes a first radiation portion, a second radiation portion, a connection portion and a feeding portion. The second radiation portion is located under the radiation portion; and is substantially parallel with the first radiation portion. The connection portion is connected to a first side of the first radiation portion, and is extended downward vertically, so as to connect the first radiation portion and the second radiation portion. The first radiation portion is operated at a first bandwidth; and the second radiation portion is operated at a second bandwidth, wherein the second bandwidth is in higher frequency than the first bandwidth. The feeding portion is connected to a second side of the first radiation portion, and is extended downward vertically. The feeding portion is for receiving a feeding signal. The first side and the second side are two opposite sides.

Preferably, in the three-dimensional dual-band antenna, the first radiation portion is in the shape of a quadrangle or a rectangle.

Preferably, in the three-dimensional dual-band antenna, the second radiation portion is in the shape of a bar.

Preferably, in the three-dimensional dual-band antenna, the length of the second radiation portion is larger than that of the first side of the first radiation portion.

Preferably, in the three-dimensional dual-band antenna, the connection portion can be used as a first supporting portion of the three-dimensional dual-band antenna.

Preferably, in the three-dimensional dual-band antenna, the feeding portion is located at the middle of the second side of the radiation portion.

Preferably, in the three-dimensional dual-band antenna, the feeding portion can be used as a second supporting portion of the three-dimensional dual-band antenna.

In the three-dimensional dual-band antenna, the feeding portion receives a feeding signal provided by the circuit board.

In the three-dimensional dual-band antenna, the circuit board includes a ground plane, and preferably, the ground plane is not located under the three-dimensional dual-band antenna.

The three-dimensional dual-band antenna further includes an impedance matching portion connected to the second side of the first radiation portion and extended downward vertically, and the impedance matching of the three-dimensional dual-band antenna can be adjusted by changing the size of the impedance matching portion.

Preferably, in the three-dimensional dual-band antenna, the impedance matching portion is in the shape of a quadrangle or a rectangle.

Preferably, in the three-dimensional dual-band antenna, the impedance matching portion can be used as a third supporting portion of the three-dimensional dual-band antenna.

The three-dimensional dual-band antenna further includes a slot on a third side of the first radiation portion for increasing the bandwidth at which the first radiation portion is operated, wherein the two ends of the third side are connected to the first side and the second side.

Preferably, in the three-dimensional dual-band antenna, the slot is in the shape of a trapezoid or a triangle whose slot diameter gradually narrows in the direction from the third side to the first radiation portion.

Preferably, in the three-dimensional dual-band antenna, the slot is on the third side of the first radiation portion, and is adjacent to the first side.

Preferably, in the three-dimensional dual-band antenna, the width of the second radiation portion is smaller than that of the third side of the first radiation portion.

The invention will become apparent from the following detailed description of the preferred but non-limiting embodiments. The following description is made with reference to the accompanying drawings.

DETAILED DESCRIPTION OF THE INVENTION

Figure 1A:
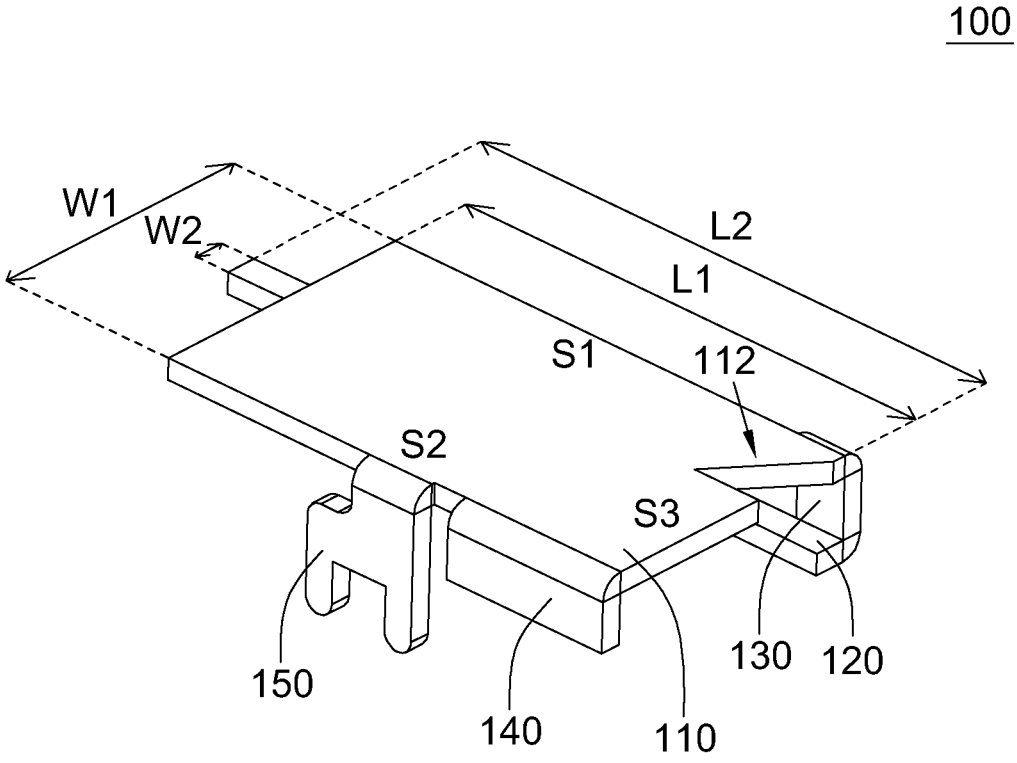
FIG. 1A shows a structural diagram of a three-dimensional dual-band antenna according to an embodiment of the invention.

Referring to FIG. 1A, a structural diagram of a three-dimensional dual-band antenna according to an embodiment of the invention is shown. The three-dimensional dual-band antenna 100 includes a first radiation portion 110, a second radiation portion 120, a connection portion 130, an impedance matching portion 140 and a feeding portion 150.

The first radiation portion 110 is in the shape of such as a quadrangle or a rectangle. The first radiation portion 110 has a slot 112 on a side S3 of the first radiation portion 110 and the slot 112 is for increasing the operation bandwidth of the first radiation portion 110. Two ends of the side S3 are respectively connected to a side S1 and a side S2. The slot 112 is in the shape of such as a trapezoid or a triangle whose slot diameter gradually narrows in the direction from the side S3 into the interior of the first radiation portion 110. Preferably, the slot is on the side S3 of the first radiation portion 110 and is adjacent to side S1 for increasing the operation bandwidth of the first radiation portion 110. However, the invention is not limited to the above exemplification. Any designs of forming a slot on the first radiation portion 110 for increasing the operation bandwidth of the first radiation portion 100 are within the scope of the invention.

The second radiation portion 120 is located under radiation portion 110 and is substantially parallel with the first radiation portion 110. The second radiation portion 120 is in the shape of such as a bar. As indicated in FIG. 1A, the length L2 of the second radiation portion 120 is larger than the length L1 of the first radiation portion 110, but the width W2 of the second radiation portion 120 is smaller than the width W1 of the first radiation portion 110.

The connection portion 130 is connected to the side S1 of the first radiation portion 110, and is extended downward vertically to connect the first radiation portion 110 and the second radiation portion 120. The connection portion 130 is as a first supporting portion of the three-dimensional dual-band antenna.

The impedance matching portion 140 is connected to the side S2 of the first radiation portion 110, wherein the side S1 and the side S2 are opposite to each other. The impedance matching portion 140 is extended downward vertically. The impedance matching portion 140 is for impedance match of the second radiation portion 120. In other words, the impedance matching of the three-dimensional dual-band antenna is adjusted by changing the size of the impedance matching portion 140. The impedance matching portion 140 is located at one side of the feeding portion 150; and the connection portion 130 is opposite to the impedance matching portion 140. Preferably, the impedance matching portion 140 is in the shape of such as a quadrangle or a rectangle. The impedance matching portion 140 is as a third supporting portion of the three-dimensional dual-band antenna.

The feeding portion 150 is connected to the side S2 of the first radiation portion 110 and is extended downward vertically. The feeding portion 150 is such as located near the middle of the side S2 as indicated in FIG. 1A. The feeding portion 150 is as a second supporting portion of the three-dimensional dual-band antenna. The ends of the feeding portion 150 are such as h-shaped. The feeding portion 150 is for receiving a feeding signal provided by a circuit board.

Figure 2:
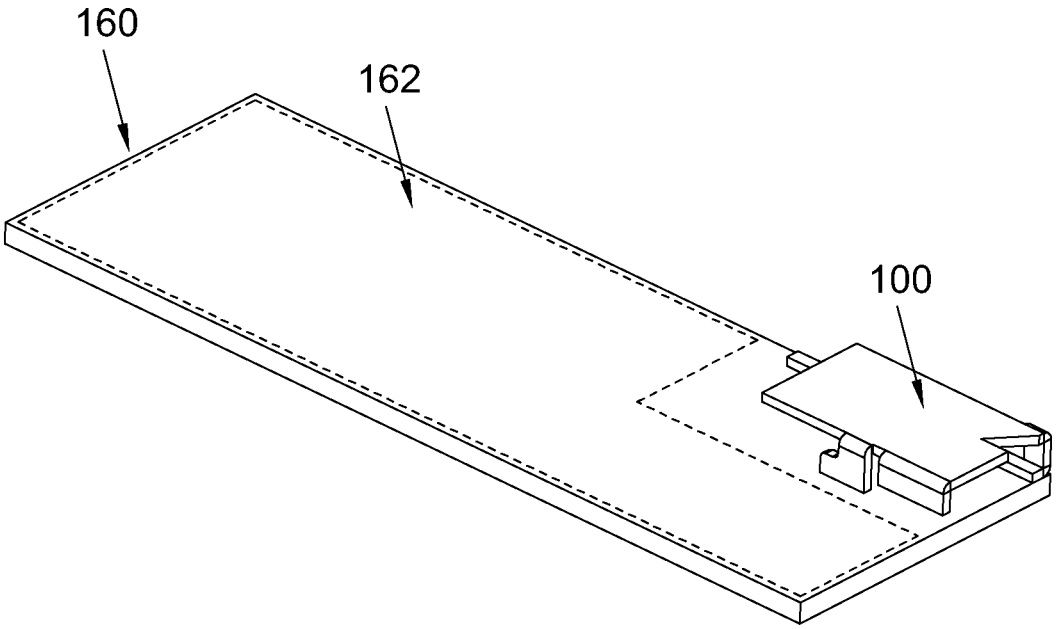
FIG. 2 shows the connection of the three-dimensional dual-band antenna of FIG. 1A with a circuit board.

Referring to FIG. 2, connection of the three-dimensional dual-band antenna of FIG. 1A to a circuit board is shown. The feeding portion 150 is connected to the circuit board 160 through the h-shaped ends; and the second radiation portion 120 is substantially disposed on the circuit board 160. The circuit board 160 provides a feeding signal; and the feeding portion 150 receives the feeding signal.

For example, the circuit board 160 has a ground plane 162 which is on the circuit board 160, as a dotted area in FIG. 2. In an exemplary embodiment, preferably, the ground plane 162 is not located under the three-dimensional dual-band antenna 100, so that the three-dimensional dual-band antenna 100 is a monopole antenna with respect to the ground plane 162.

Referring to the FIG. 1A. In practical application, the first radiation portion 110 provides a first resonance frequency; and the second radiation portion 120 provides a second resonance frequency. The second resonance frequency is higher than the first resonance frequency. The two resonance frequencies are such as within the communication bandwidths defined by IEEE (Institute of Electrical and Electronics Engineers) standards 802.11 a/b/g/n.

In more details, the first radiation portion 110 is operated at a first bandwidth substantially ranging between 2.1 GHz~3.1 GHz. The second radiation portion 120 is operated at a second bandwidth substantially ranging between 4.9 GHz~5.85 GHz. Thus, the three-dimensional dual-band antenna 100 supports the communication bandwidths ranging between 2.4~2.5 GHz and between 4.9 GHz~5.85 GHz. A number of test wave patterns are exemplified below.

Figure 3:
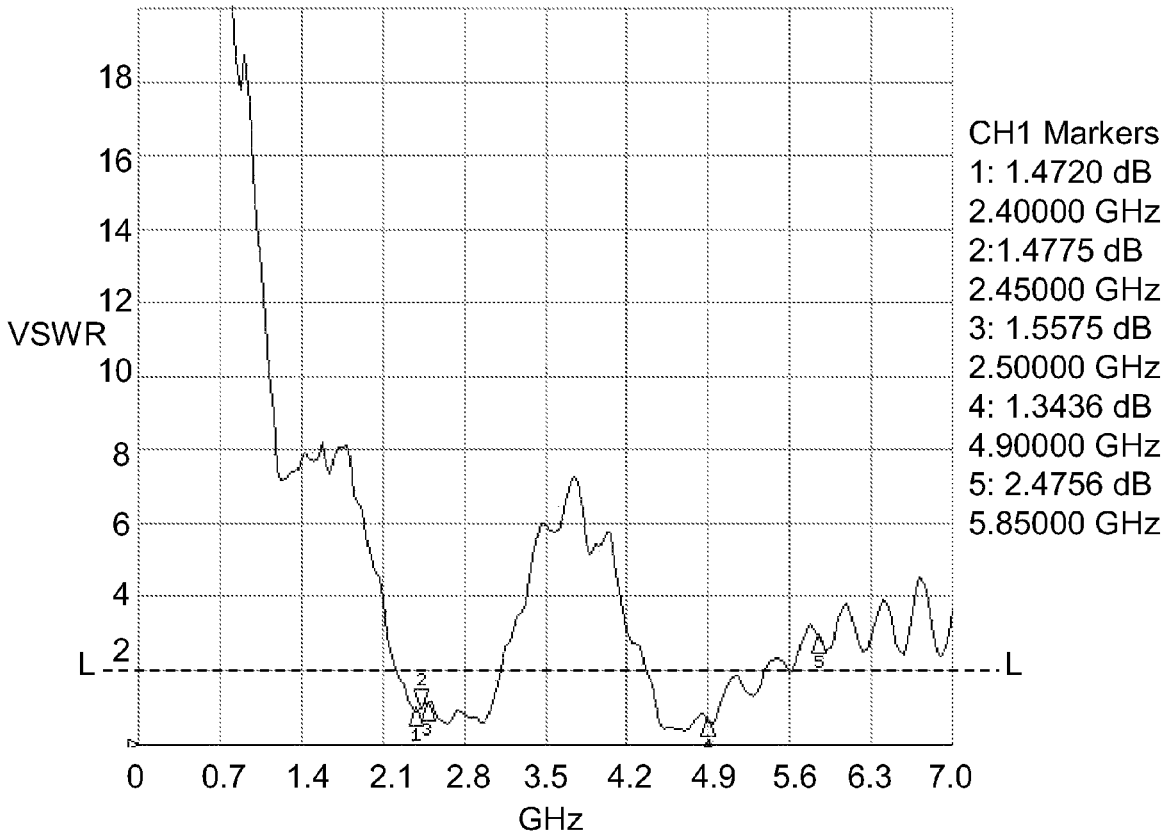
FIG. 3 shows an SWR pattern of the three-dimensional dual-band antenna of FIG. 2.

Referring to FIG. 3, an SWR pattern of the three-dimensional dual-band antenna of FIG. 2 is shown. According to the reference line L with standing wave ratio (SWR) of 2, the first bandwidth substantially ranges between 2.1 GHz~3.1 GHz; the second bandwidth substantially ranges between 4.9 GHz~5.85 GHz. The first bandwidth substantially covers the low frequency communication bandwidth ranging between 2.4 GHz~2.5 GHz defined in IEEE standards 802.11a/b/g/n; and the second bandwidth substantially covers the high frequency communication bandwidth ranging between 4.9 GHz~5.85 GHz defined in IEEE standards 802.11a/b/g/n.

As indicated in FIG. 3, the actual SWR values at 2.4 GHz, 2.45 GHz, 2.5 GHz, 4.9 GHz, and 5.85 GHz (respectively denoted by five measuring points 1~5 in FIG. 3) are 1.4720, 1.4775, 1.5575, 1.3436 and 2.4756 respectively. Thus, the three-dimensional dual-band antenna 100 of the present embodiment of the invention can effectively supports IEEE 802.11 standards a/b/g/n.

Moreover, the three-dimensional dual-band antenna 100 of the embodiment of the invention supports broadband and accordingly is called broadband antenna. The central frequency bandwidth ratio (that is, the ratio of the central frequency and the bandwidth) of the broadband antenna normally is higher than 15%. In the three-dimensional dual-band antenna 100 of the embodiment of the invention, the first bandwidth is about 1 GHz (that is, 3.1 GHz−2.1 GHz=1 GHz). Let the central frequency be 2.5 G. The central frequency bandwidth ratio of the first bandwidth is 40% (1 G/2.5 G=40%), which is larger than 15%, so the three-dimensional dual-band antenna 100 has broadband characteristic at the first bandwidth. Likewise, the second bandwidth is also near 1 GHz (5.85 GHz−4.9 GHz=0.95 GHz); and the central frequency bandwidth ratio of the second bandwidth is also larger than 15%, so the three-dimensional dual-band antenna 100 also has broadband characteristic at the second bandwidth.

Figure 4A:
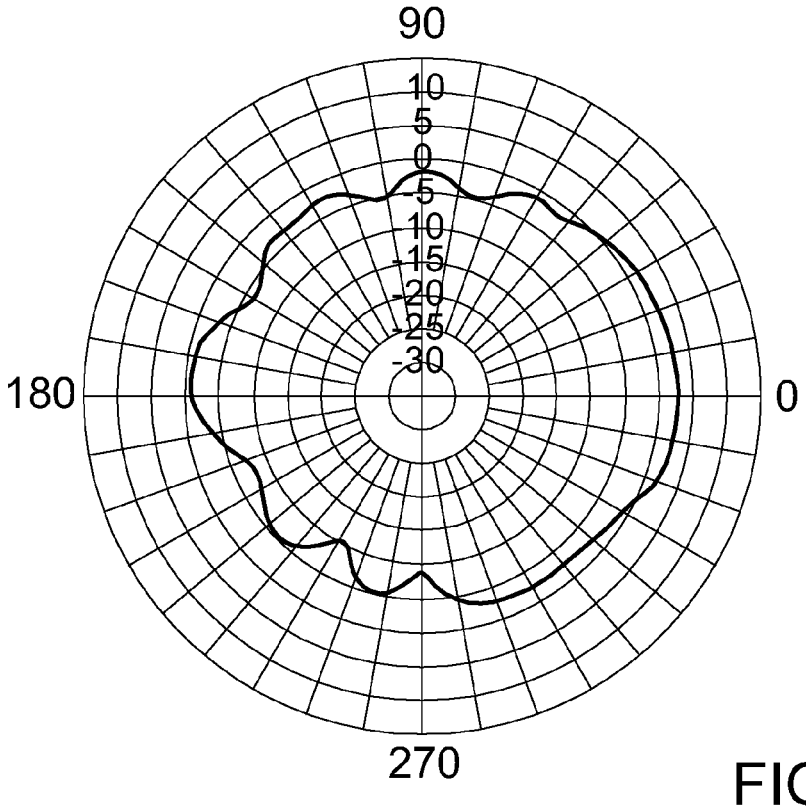
FIGS. 4A~4C show the vertical field patterns of the three-dimensional dual-band antenna of FIG. 2 operated at 2.40 GHz, 2.45 GHz, and 2.50 GHz respectively.
Figure 4B:
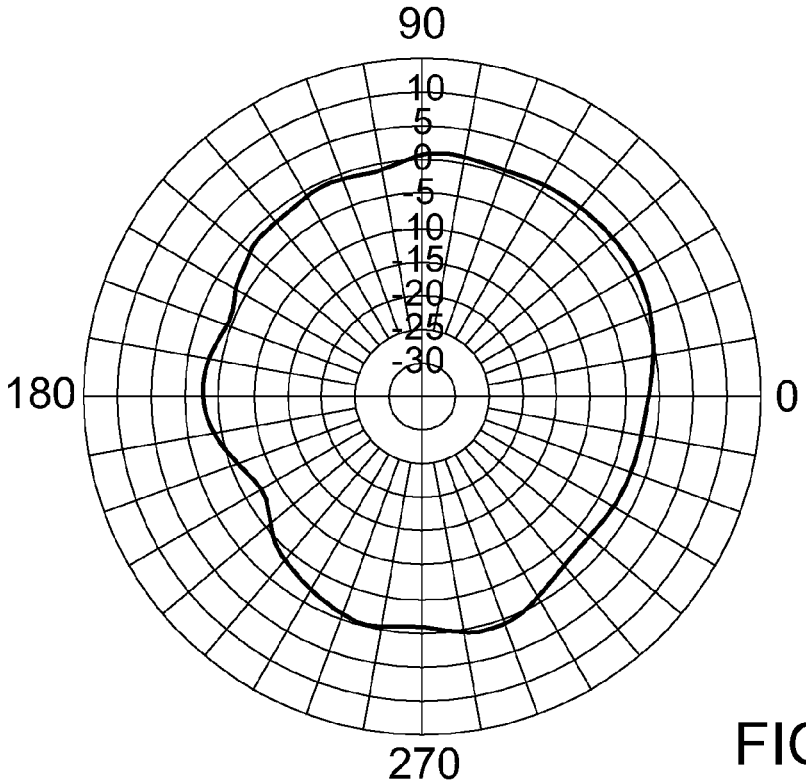
Figure 4C:
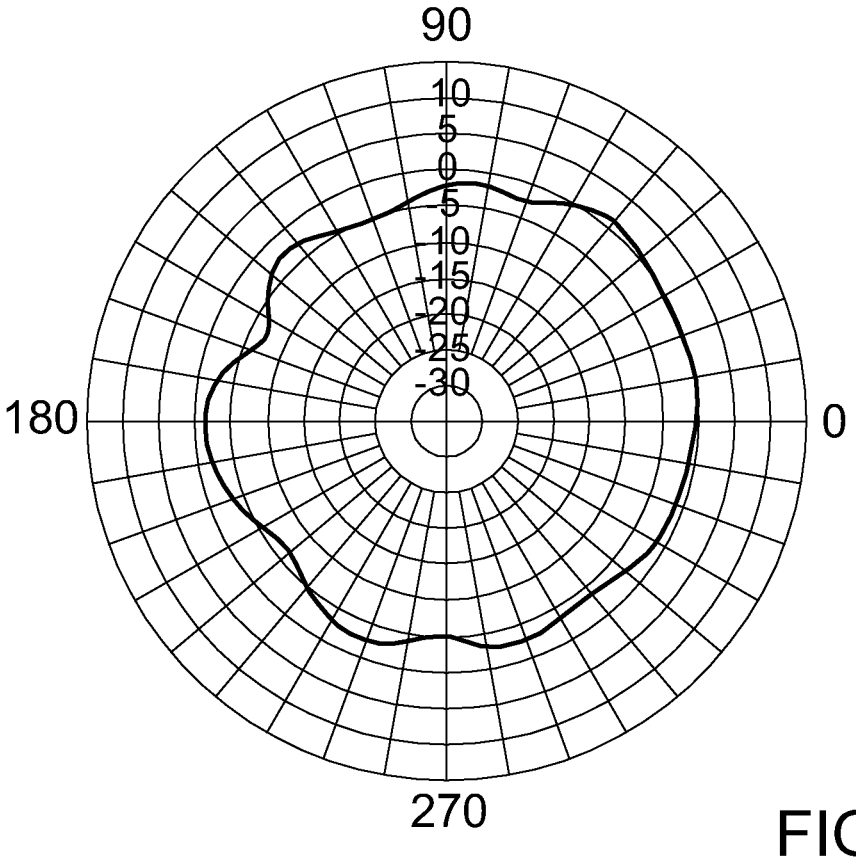
Figure 5A:
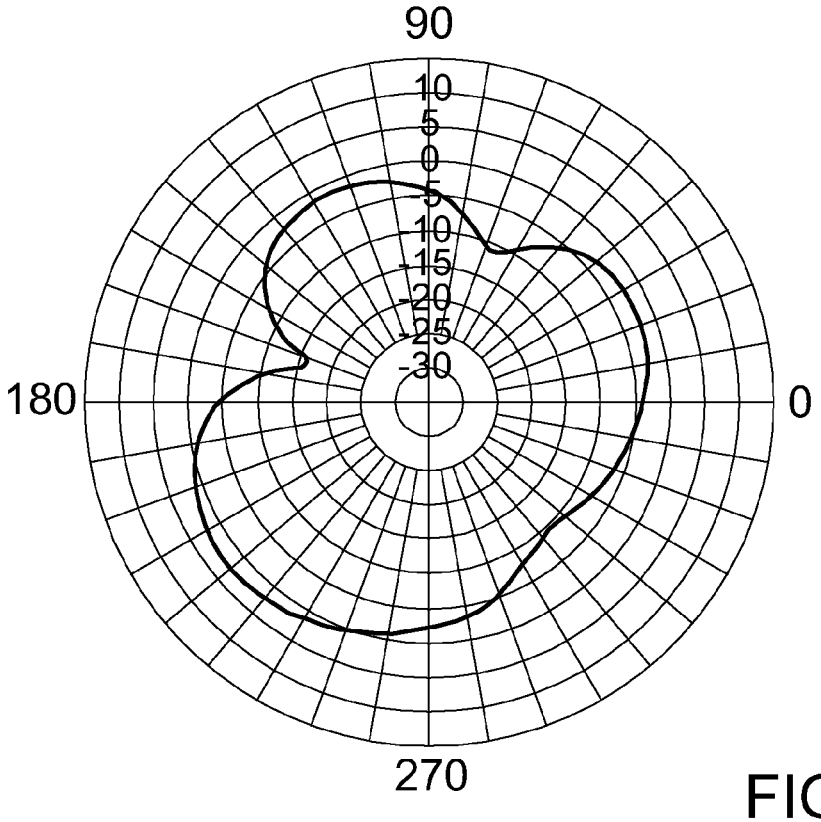
FIGS. 5A~5D show the vertical field patterns of the three-dimensional dual-band antenna of FIG. 2 operated at 5.15 GHz, 5.35 GHz, 5.75 GHz, and 5.85 GHz respectively.
Figure 5B:
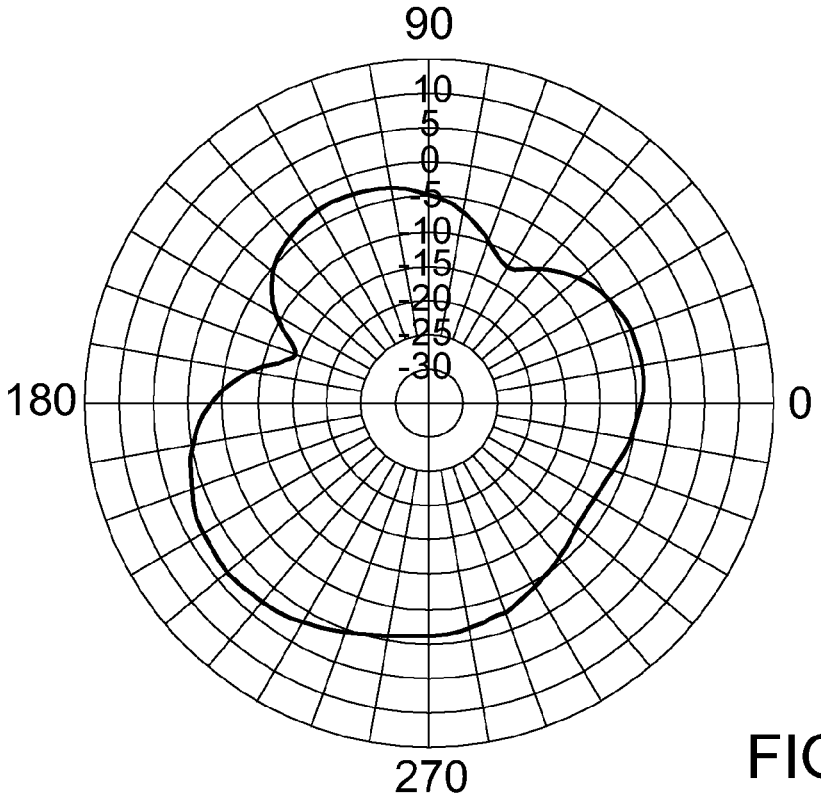
Figure 5C:
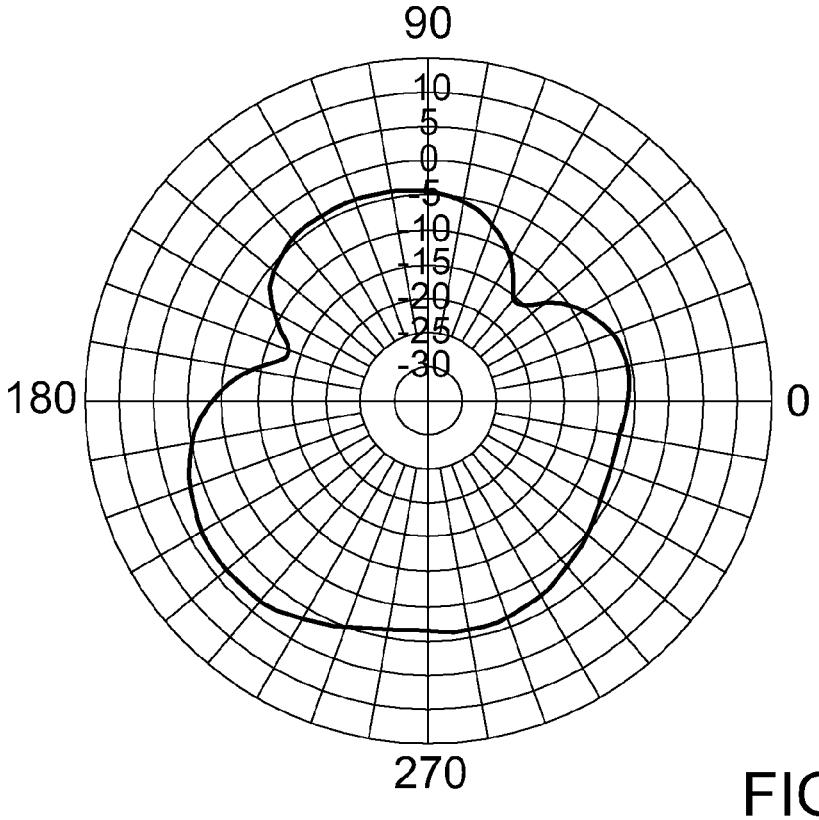
Figure 5D:
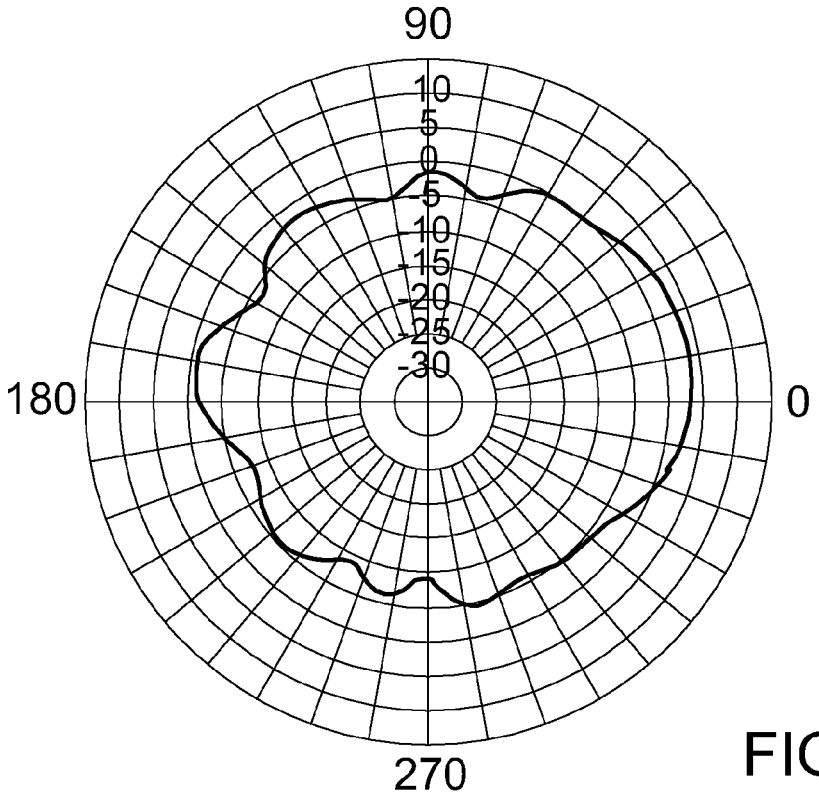

A vertical polarization gain field pattern of the three-dimensional dual-band antenna 100 is disclosed below. FIGS. 4A-4C show the vertical polarization gain field patterns of the three-dimensional dual-band antenna 100 of FIG. 2 operated at 2.40 GHz, 2.45 GHz, and 2.50 GHz respectively. FIGS. 5A~5D show the vertical polarization gain field patterns of the three-dimensional dual-band antenna 100 of FIG. 2 operated at 5.15 GHz, 5.35 GHz, 5.75 GHz, and 5.85 GHz respectively. As indicated in FIGS. 4A~4C and FIGS. 5A~5D, at the low frequency between 2.4 GHz~2.5 GHz and at the high frequency between 4.9 GHz~5.85 GHz defined by IEEE standards 802.11 a/b/g/n, the three-dimensional dual-band antenna 100 of the embodiment of the invention has excellent radiation performance.

Figure 1B:
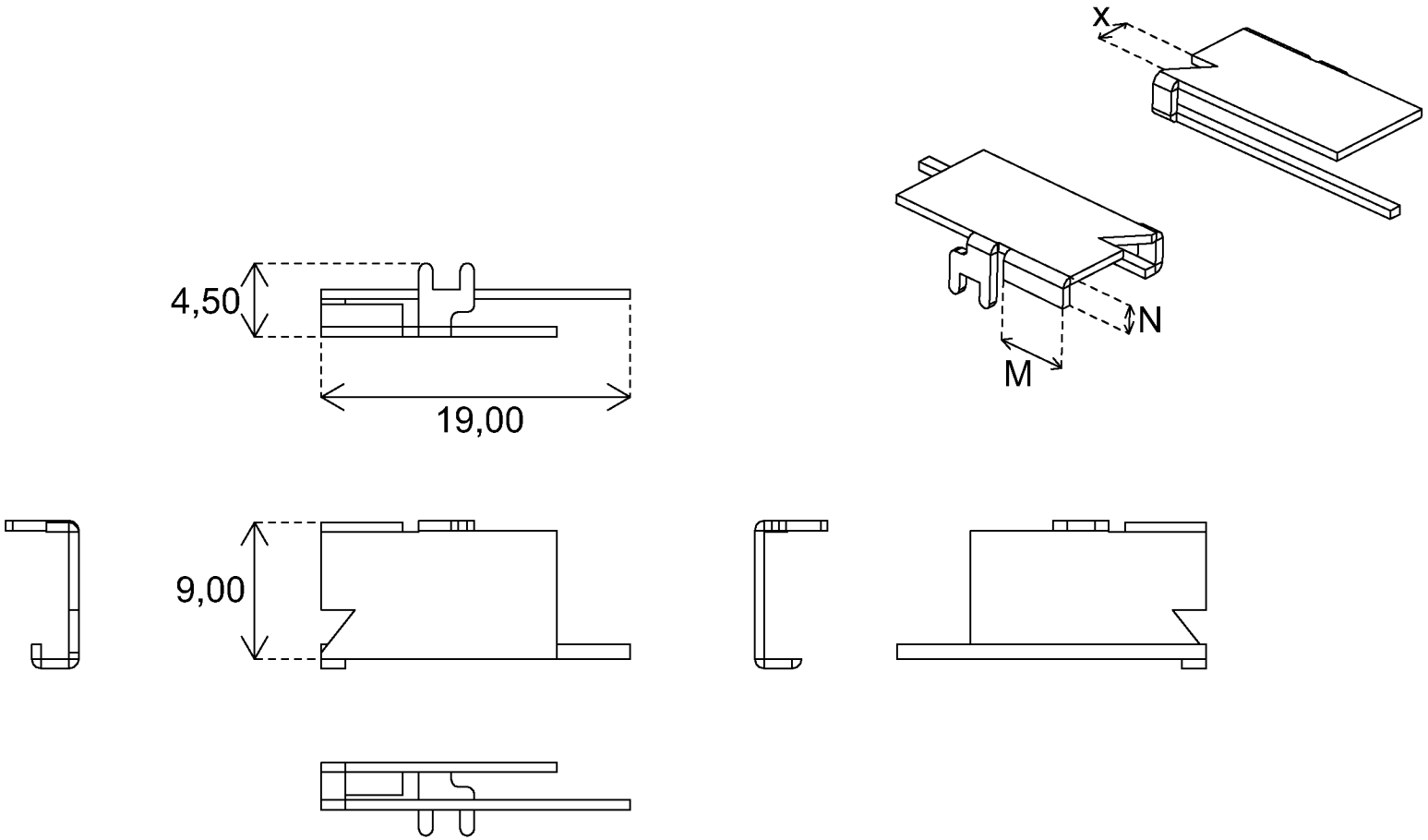
FIG. 1B shows multiple views of the three-dimensional dual-band antenna of FIG. 1A.

Referring to FIG. 1B, multiple views of the three-dimensional dual-band antenna 100 of FIG. 1A are shown. In the present embodiment, the three-dimensional dual-band antenna 100 has a small-sized volume; and the length, the width and the height of the three-dimensional dual-band antenna 100 are about 19 mm, the 9 mm, and 4.5 mm respectively. Moreover, the bottom length of the triangle slot 112 is about 2.6 mm; the impedance matching portion 140 is in the shape of such as a rectangle whose length is about 5.0 mm and width is about 2.0 mm. The three-dimensional dual-band antenna 100 is formed by materials including metals, so that the three-dimensional dual-band antenna 100 of the embodiment of the invention is used as a three-dimensional metal dual-band antenna. The three-dimensional dual-band antenna 100 of the embodiment of the invention is applicable to a handheld device or a universal serial bus (USB) device.

The three-dimensional dual-band antenna disclosed in the above embodiment of the invention is capable of supporting two communication bandwidths and has a small-sized volume. The three-dimensional dual-band antenna of the invention can receive/transmit signals at wide communication bandwidth, so the two communication bandwidths supported by the three-dimensional dual-band antenna of the embodiment of the invention both have broadband characteristic.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A three-dimensional dual-band antenna, comprising:

a first radiation portion having a slot;

a second radiation portion located under the first radiation portion and parallel with the first radiation portion, wherein the first radiation portion is operated at a first bandwidth, the second radiation portion is operated at a second bandwidth, and the second bandwidth is a higher frequency band than the first bandwidth;

a connection portion connected to a first side of the first radiation portion and extended downward vertically, for connecting the first radiation portion and the second radiation portion;

an impedance matching portion connected to a second side of the first radiation portion and extended downward vertically, wherein the first side and the second side are opposite to each other; and a feeding portion connected to the second side of the first radiation portion and extended downward vertically, wherein the feeding portion is for receiving a feeding signal, and the slot of the first radiation portion is in a shape of a trapezoid or a triangle whose slot diameter gradually narrows in a direction from the third side toward the first radiation portion.

2. The three-dimensional dual-band antenna according to claim 1, wherein the connection portion is as a first supporting portion of the three-dimensional dual-band antenna.

3. The three-dimensional dual-band antenna according to claim 1, wherein the first bandwidth ranges between 2.1 GHz~3.1 GHz; and the second bandwidth ranges between 4.9 GHz~5.85 GHz.

4. The three-dimensional dual-band antenna according to claim 1, wherein the slot of the first radiation portion is on a third side of the first radiation portion and adjacent to the first side;

wherein two ends of the third side are connected to the first side and the second side, respectively.

5. The three-dimensional dual-band antenna according to claim 1, wherein a bottom length of the slot is about 2.6 mm.

6. The three-dimensional dual-band antenna according to claim 1, wherein the first radiation portion is in shape of a quadrangle or a rectangle.

7. The three-dimensional dual-band antenna according to claim 1, wherein the second radiation portion is in shape of a bar.

8. The three-dimensional dual-band antenna according to claim 1, wherein the second radiation portion is longer than the first radiation portion; and the second radiation portion is narrower than the first radiation portion.

9. The three-dimensional dual-band antenna according to claim 1, wherein the impedance matching portion is for impedance match of the second radiation portion.

10. The three-dimensional dual-band antenna according to claim 1, wherein the impedance matching portion is in shape of a quadrangle or a rectangle whose length is about 5.0 mm and whose width is about 2.0 mm.

11. The three-dimensional dual-band antenna according to claim 1, wherein the feeding portion is located near a middle of the second side; the impedance matching portion is located at one side of the feeding portion; and the connection portion is opposite to the impedance matching portion.

12. The three-dimensional dual-band antenna according to claim 1, wherein the feeding portion is as a second supporting portion of the three-dimensional dual-band antenna.

13. The three-dimensional dual-band antenna according to claim 1, wherein the impedance matching portion is as a third supporting portion of the three-dimensional dual-band antenna.

14. The three-dimensional dual-band antenna according to claim 1, wherein the feeding portion is connected to a circuit board providing the feeding signal.

15. The three-dimensional dual-band antenna according to claim 14, wherein the circuit board has a ground plane and the ground plane is not located under the three-dimensional dual-band antenna, so that the dual-band antenna is a monopole antenna with respect to the ground plane.

16. The three-dimensional dual-band antenna according to claim 13, wherein the second radiation portion is pasted on the circuit board.

17. The three-dimensional dual-band antenna according to claim 1, wherein the three-dimensional dual-band antenna is made by metal.

18. The three-dimensional dual-band antenna according to claim 1, wherein the three-dimensional dual-band antenna is applicable to a handheld device or a universal serial bus (USB) device.

19. The three-dimensional dual-band antenna according to claim 1, wherein the first radiation portion provides a first resonance frequency; the second radiation portion provides a second resonance frequency; and the second resonance frequency is higher than the first resonance frequency.

* * * * *